US007562702B2

(12) United States Patent
Bertane et al.

(10) Patent No.: US 7,562,702 B2
(45) Date of Patent: Jul. 21, 2009

(54) DRAIN CAP STUFFING BOX

(75) Inventors: Mark Bertane, Glen Ellyn, IL (US); Michael Dominik, Homewood, IL (US)

(73) Assignee: Blackhawk Environmental Co., Glen Ellyn, IL (US)

( * ) Notice: Subject to any disclaimer, the term of this patent is extended or adjusted under 35 U.S.C. 154(b) by 231 days.

(21) Appl. No.: 11/132,524

(22) Filed: May 19, 2005

(65) Prior Publication Data

US 2006/0260800 A1 Nov. 23, 2006

(51) Int. Cl.
*E21B 33/03* (2006.01)

(52) U.S. Cl. ..... 166/84.1; 166/75.13; 166/88.1; 166/81.1; 277/329

(58) Field of Classification Search ..... 166/369, 166/84.1, 88.1, 75.13, 81.1; 277/329, 530
See application file for complete search history.

(56) References Cited

U.S. PATENT DOCUMENTS

| | | | | |
|---|---|---|---|---|
| 967,498 | A | | 8/1910 | Clark |
| 1,118,787 | A | | 11/1914 | McGee |
| 1,453,324 | A | * | 5/1923 | Purtle ..... 384/16 |
| 2,154,331 | A | | 4/1939 | Hathcock |
| 2,229,539 | A | | 1/1941 | Zublin |
| 2,266,935 | A | * | 12/1941 | Stephens et al. ..... 277/323 |
| 2,281,801 | A | | 5/1942 | Reynolds et al. |
| 2,605,717 | A | | 8/1952 | Canon |
| 2,743,676 | A | | 5/1956 | Lewis |
| 2,982,355 | A | | 5/1961 | Rodgers |
| 4,217,212 | A | | 8/1980 | Deal |
| 4,480,685 | A | * | 11/1984 | Gilbertson ..... 166/68.5 |
| 4,628,994 | A | | 12/1986 | Towner et al. |
| 4,637,462 | A | | 1/1987 | Grable |
| 4,643,258 | A | | 2/1987 | Kime |
| 4,669,536 | A | | 6/1987 | Ames et al. |
| 4,678,369 | A | | 7/1987 | Glaser |
| 4,688,999 | A | | 8/1987 | Ames et al. |
| 4,765,902 | A | | 8/1988 | Ely et al. |
| 4,768,595 | A | | 9/1988 | Smith |
| 4,810,131 | A | | 3/1989 | Turner |
| 4,927,292 | A | | 5/1990 | Justice |

(Continued)

OTHER PUBLICATIONS

Product literature from Baker, 133 Enterprise Street, Evansville, Wisconsin 53536 for Monitor PowerSaver, Jacks, Pumps, Well Supplies, Catalog AD10, Mar. 1, 1989. With price list effective Oct. 1, 1992.

(Continued)

*Primary Examiner*—Shane Bomar
(74) *Attorney, Agent, or Firm*—Marshall, Gerstein & Borun LLP

(57) ABSTRACT

As may be used in a positive displacement pump system, a capped stuffing box assembly includes a stuffing box mountable to a discharge tee to prevent pumped fluid from escaping collection via the discharge tee. The stuffing box is capped by a drain cup that may be releasably mounted to the stuffing box and fixedly mounted to a drive pump motor frame, the drain cap having a drain port to communicate leakage upon failure or pre-failure of the seals in the stuffing box. Upon such failure, the stuffing box may be removed from the drain cap and replaced, while alignment between the actuating rod, drive motor, pump actuator, and drain cap is maintained.

20 Claims, 4 Drawing Sheets

U.S. PATENT DOCUMENTS

| | | | | |
|---|---|---|---|---|
| 4,966,534 | A | 10/1990 | Hasslen, III | |
| 4,992,030 | A | 2/1991 | Hasslen, III | |
| 5,106,232 | A | 4/1992 | Metzer et al. | |
| 5,211,227 | A * | 5/1993 | Anderson | 166/84.1 |
| 5,246,067 | A * | 9/1993 | Heinonen et al. | 166/81.1 |
| 5,372,352 | A * | 12/1994 | Smith et al. | 251/214 |
| 5,429,193 | A | 7/1995 | Hegebarth et al. | |
| 2002/0179300 | A1 * | 12/2002 | Gay et al. | 166/81.1 |

OTHER PUBLICATIONS

Product literature from Dempster Industries, Inc., Beatrice, Nebraska 68310; data Sheet 380-2, Issue Date 1981, concerning Pump Jack; sheets 19-20 with indications Dec. 1, 1991, concerning non-powered pump jacks and non-powered jack components; data sheet 380-383 issue date 1980 concerning pumps and cylinders; sheets 5-6 with indications Jan. 30, 1993 concerning hand & wind mill pumps and pumps accesories.

Product literature from EPG Companies Inc., P.O. Box 224, 9060 Zachary Lane N., Suite 115, Maple Grove, Minnesota 55369, concerning the SurePump™ Leachate Removal System from EPG Companies with notation protected by U.S. Pat. No. 4,966,534 and 4,992,030.

Product literature from Harbison-Fischer, P.O. Box 2477, Forth Worth, Texas 76113, 1994-1995 Condensed Catalog for Harbison-Fisher Sub-Surface Pumps.

Product literature from Instrumentation Northwest, Inc., 14972 N.E. 31st Circle, Redmond, WA 98052, concerning HydroStar™ Ground Water Sampling System.

Product literature from Instrumentation Northwest, Inc., 14972 N.E. 31st Circle, Redmond, WA 98052, HydroStar™ Technical Information Document for the Bertane Company.

Product literature from Mass Midwest, P.O. 547, 11213 Dundee Road, Huntley, Illinois 60142-0547, Catalog 500.

Product literature from Muller Industries, Incorporated, Randolph, Nebraska 68771 U.S. Highway 81 North.

Product literature from Protec®, 7136 S. Yale, Suite 200, Tulsa, Okla. 74136, concerning the Protec® Recip® Pump Groundwater & Leachate Recovery Pumps and Protec® Rotary® Pump Groundwater Recovery Pumps.

Product literature from Trico Industries, Inc., 3040 E. Slauson Avenue, P.O. Box 2909, Huntington Park, California 90255, 1990-1991 Catalog.

Product literature from Instrumentation Northwest, Inc. 14972 NE 31st Circle, Redmond, Wash. 98052 pertaining to Hydrostar™ Ground Water Sampling Pump.

Product literature for Fiberflex® The Fiberglass Sucker Rod, P.O. Box 6044, Industrial Park, Big Spring, Texas 79721-6044.

Product literature for The Anchor Pumps®, Blackhawk Environmental Company, 21W159 Hill Avenue, Glen Ellyn, Illinois 60137.

Product literature, Installation and Operating Instructions, Blackhawk Environmental Company, 21W159 Hill Avenue, Glen Ellyn, Illinois 60137.

Hicks, A.W., "Using Fiberglass Sucker Rods in Deep Wells," presented at the Deep Drilling and Production Symposium of the Society of the Society of Petroleum Engineers, Apr. 6-8, 1986, Austin, Texas.

Hicks, Alan W., "Chemical Corrosion and its Effect on Fiberglass Sucker Rods," presented as the Southwestern Petroleum Short Course Department of Petroleum Engineering, Texas Tech University, Lubbock, Texas, Apr. 27-28, 1983.

Enhanced Stuffing Box Rubbers Test Report, Nov. 2001-Jun. 2002 (Jul. 2002).

Product literature from R & M Energy Systems, pertaining to Ultra-Guard™ Sealing System, R&M Energy Systems' Ultra-Guard™ Sealing System Eliminates Stuffing Box Leakage (2001).

Product literature from R & M Energy Systems, pertaining to Hercules® General Products (2004).

* cited by examiner

DRAIN CAP STUFFING BOX

FIELD OF THE DISCLOSURE

This invention relates generally to devices and methods for pumping liquids and more particularly to devices and methods for pumping liquids from a well or below surface reservoir.

BACKGROUND OF THE INVENTION

There are a variety of techniques for pumping fluids from underground reservoirs. Over a hundred years ago, general windmill and hand pump systems were developed to access well water for drinking and irrigation. Oil well piston pumps with top head pump jacks were also developed to recover oil. These devices used top head drive piston pumps and stand pipes for the fluid discharge. This basic technology, albeit in more advanced forms, is in use today. Of course today, pumping systems are used in a variety of applications and come in a variety of other forms as well.

Both the water well and oil well top head drive piston pumps had to address the problem of liquid discharge of liquid at the surface. The liquid discharge needs to be directed and pumped. Many modern pumping techniques, for example, are called upon to pump underground fluid in a liquid sealed manner. This is particularly useful because in many applications, such as leachate removal from a landfill, oil and tar removal from petroleum or chemical facilities and clean up of remediation sites, tank farms, pipe lines, manufactured glass plant (MGP) sites, and caisson sumps, the fluids being pumped can be hazardous to people and the environment. As a result, it is desirable to have a pumping system that prevents leakage.

To prevent leakage, water well and oil well piston pump systems use a stuffing box mounted near the top of the ground seal for the well. Stuffing box systems use a positive displacement drive rod piston to pump fluid into a discharge tee that channels the liquid to a desired location, such as a collection area or processing unit. Because this pumping can be against substantial back pressure, the stuffing box acts to counter this back pressure and direct the discharge through the discharge tee. The stuffing box forms a tight seal above the discharge tee and around the reciprocating drive rod to prevent pumped fluid from spilling on the reciprocating rod drive mechanism or seeping around the reciprocating drive rod onto the ground.

Current stuffing box designs, however, fail to give long enough liquid sealing life. The stuffing box packing seal material is constantly being worn away causing leakage and the need to constantly tighten down on the packing gland jam nut squeezing the surrounding packing material around the drive rod to stop leakage. This especially occurs where pumps are used to pump against substantial back pressure (liquid head pressure) and where pumps are used to pump fluid with substantial amounts of grit or other contaminants.

Current packing gland stuffing box designs suffer from short sealing life. For example, stuffing boxes that use packing gland design and packing materials for sealing are problematic because of the constant need to compress the packing material down against the reciprocating drive rod. In these devices, materials like graphite impregnated twine (plumber's oakum) or slant cut split rubber o-rings are slipped around the drive rod and used as the packing material, screwed down in the stuffing box by a packing gland nut to create a liquid tight seal against the drive rod. The packing material has to be compressed just right to form a tight seal, however. If the material is too compacted, the material may squeeze against the drive rod and cause stalling of the pumping system. If the packing material is too loose, fluid leakage will occur.

In other words, for the stuffing box to work, packing material needs to be in a certain operational range. This optimization can be difficult to achieve even during the initial installation, but even more problematic, is that movement of the drive rod will affect the amount of packing on the packing material. The reciprocating action of the sucker rod in the riser pipe will wear away the packing material, unpacking the material around the drive rod necessitating tightening the packing gland to confine the packing material or replacement of the stuffing box packing material or finding some way of re-packing the packing material into the desired, operable range.

With current stuffing box designs, there is also no mechanism to identify a seal failure before failure occurs on the stuffing box, and open leakage occurs. If the packing material is no longer in the desired, operable range, the stuffing box will start to leak and can cause environmental or physical damage before the leaking is even detected. It is desirable, therefore, to have a stuffing box that can provide some pre-indication of such leakage.

A problem with current u-cup stuffing box design is alignment. In particular, when the seals of a stuffing box begin to fail, fluid leakage can occur. In such circumstances it is quite difficult to replace the stuffing box, because the entire stuffing box must be removed from the pump motor frame in order to replace its failed internal seals, seals which have likely corroded or degraded and thus no longer seal against the drive rod. Furthermore, unless the drive motor frame and the stuffing box seal are properly aligned upon replacement, then not only could the stuffing box seals fail more quickly, but misalignment could cause premature failure of the expensive, pneumatic drive motor air cylinder.

SUMMARY OF THE INVENTION

In accordance with an embodiment, provided is a stuffing box assembly for use in a pumping system for communicating fluid with a well casing, the pumping system having a drive motor mounted to a frame, the stuffing box assembly comprising: stuffing box mounted to a discharge tee coupled to the well casing, the stuffing box having a first liquid seal region to protect against fluid leakage; and a stuffing box cap removably mounted to the stuffing box and coupled to the frame, the stuffing box cap having a second liquid seal region to protect against fluid leakage and the stuffing box cap having a drain port for draining leaked fluid leakage.

In accordance with another embodiment, provided is a pumping assembly for pumping fluid from an underground reservoir through a well casing, the pumping assembly comprising: a frame; a piston rod drive assembly mounted to the frame for actuating a piston rod in the well casing to pump fluid through the well casing; a first sealing assembly releasably mounted to the well casing, the first sealing assembly sealing against the piston rod during actuating movement: and a second sealing assembly fixedly mounted to the frame and releasably mounted to the first sealing assembly, the second sealing assembly sealing against the piston rod during actuating movement and having a drain port for communicating fluid leakage from the first sealing assembly.

DETAILED DESCRIPTION

Figure 1:
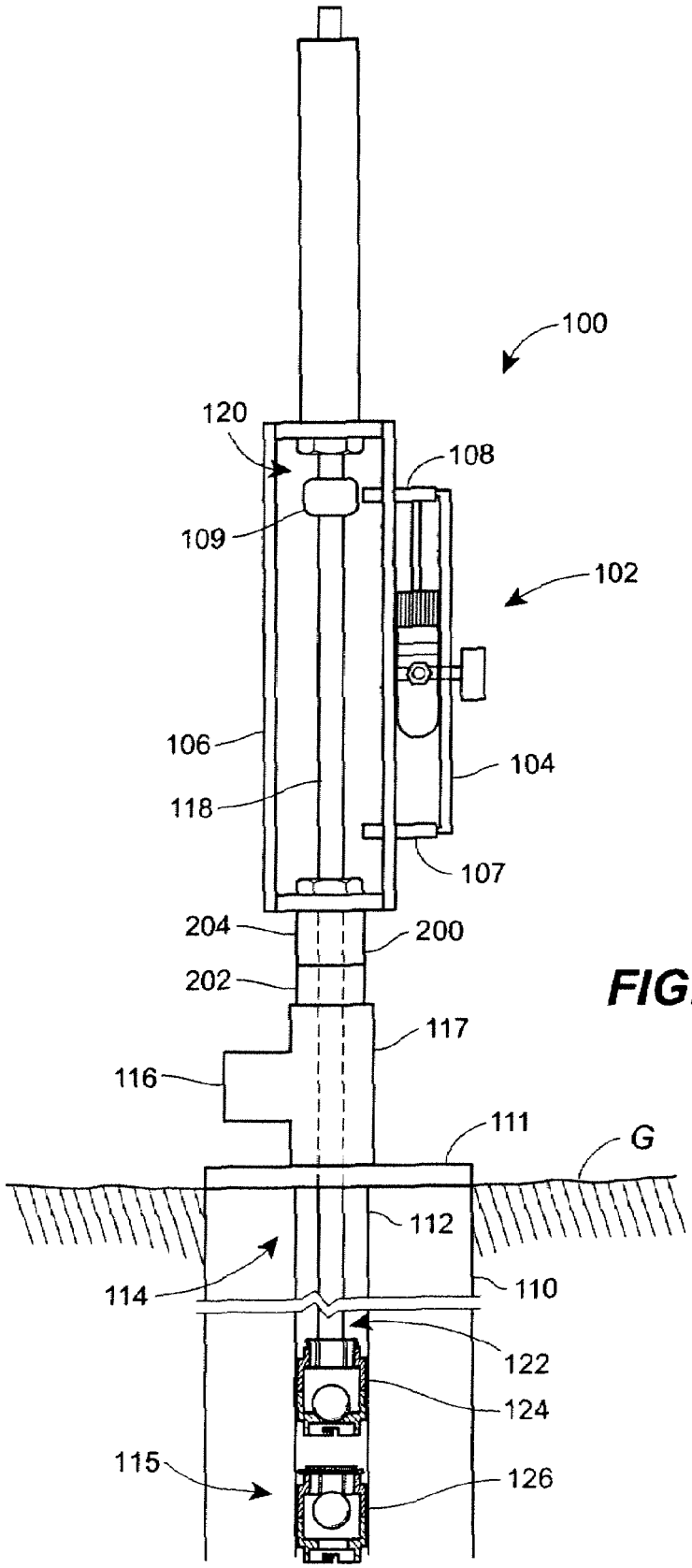
FIG. 1 illustrates a partial cross-section of an example pumping system including a drive motor and frame.

FIG. 1 illustrates a pumping system 100 that may be useful in pumping liquid, such as groundwater, hydrocarbons, tar, oil, chemicals or landfill leachate, through a well in a landfill or other geological site, for example, for collection analysis, consumption or disposal of the liquid. The system 100, of the illustrated example, has a drive motor assembly 102 having a piston pump actuator 104 mounted to a frame 106 (illustrated partially uncovered to display the inside) and with two limit switches 107, 108 for detecting a trigger element 109 for controlling operation of the drive motor 102. The drive motor assembly 102 is mounted to a drilled well casing 110 (illustrated partially uncovered to display the inside), via a well head 111, shown at the top surface (G) of a geological site. By way of example not limitation, the casing 110 may be formed of an organic polymer, such as polyvinyl chloride (PVC) or high density polyethylene (HDPE). Depending on the temperatures of the application other materials may be more suited, such as particularly treated PVCs, like chlorinated polyvinyl chloride (CPVC). Stainless steel, black iron, or fiberglass may be used to form the casing 110, as well. Example drive motor assemblies include the ANCHOR PUMP and TRIDENT PUMP assemblies available from Blackhawk Environmental, of Glenn Ellyn, Ill.

The linear drive motor assembly 102 controls the pump actuator 104 for use in fluid pumping. Example actuators include a reciprocating air-driven cylinder, a hydraulically-driven cylinder, a mechanically-driven actuator, and an electrically-driven cylinder. The linear drive motor assembly 102 may have a fixed travel distance with a fixed or adjustable cycle rate, for example. In yet other examples, the drive assembly 102 may have a variably-traveling cylinder and/or a fixed cycle rate or a windmill.

A hollow cylindrical casing or riser pipe 112 for channeling liquid extends into the well casing 110 at the geological site, and includes an upper end 114 and a lower end 115. Although not shown, a hollow casing liner or sleeve may be used to line the casing 110 and affect piston rod movement. The ends of both the well casing 110 and the liner would permit liquid to pass through them during operation of the device. A discharge opening 116 of a discharge tee 117 is disposed near an upper end of the well casing 110 and sealably coupled to the well head 111, for removal of the liquid being pumped. The discharge opening 116 may be connected to a discharge conduit, for example, through which the liquid elevated from the well may be removed for subsequent collection, analysis, consumption, disposal, or the like.

An actuating rod 118, also known as the drive rod, piston rod, or sucker rod, is shown axially disposed within the casing 110, the actuating rod 118 including an upper end 120 and a lower end 122. The actuating rod 118 may be formed of materials such as those used for the casing 110, for example and not by way of limitation. The rod 118 may be a chrome-plated stainless steel or other hardened material, including aluminum, TORLON (a polyamideimide) available from Solvay Advanced Polymers of Alpharetta, Ga., ULTEM available from General Electric Company of Fairfield, Conn., and TEFLON available from E.I. du Pont, of Wilmington, Del. A drive rod valve 124 is coupled to the rod 118 at the lower end 122, so that together the two form an assembly for elevating liquid toward the discharge opening 116.

A foot valve unit 126 is disposed within riser pipe 112 and below the drive rod valve 124 and may remain in a substantially fixed position relative to the riser pipe 112 during movement of the piston assembly. The foot valve 126 may be disposed within a liner of the riser pipe 112, for example. Alternatively to the embodiments shown, more than one drive rod valve 124 and/or more than one foot valve 126 may be incorporated in the device. Further in some examples, the foot valve 126 may be disposed outside the riser pipe 112, sealably attached to the lower end 115 of the riser piper 112. Further still, while the drive rod valve 124 and the foot valve 126 are illustrated as ball valves, other valve structures may be used to allow liquid flow through a valve aperture toward the discharge opening 116 and to prevent substantial black flow back into the underground reservoir.

By way of example, not limitation, the drive rod valve 124 and foot valve 126 may be formed of various materials such as the materials for the casing 110. Preferably, the materials are chemically inert with respect to the fluid being pumped, resistant to corrosion, durable over long life cycles and can form a liquid tight seal with whatever materials are chosen for seals, such as those described herein. By way of example, not limitation, example materials include polytetrafluoroethylene (PTFE) and stainless steel. Other materials include industrial ceramics, chemically resistant organic polymers, and metallic alloys, a list provided by way of example, not limitation.

Figure 2:
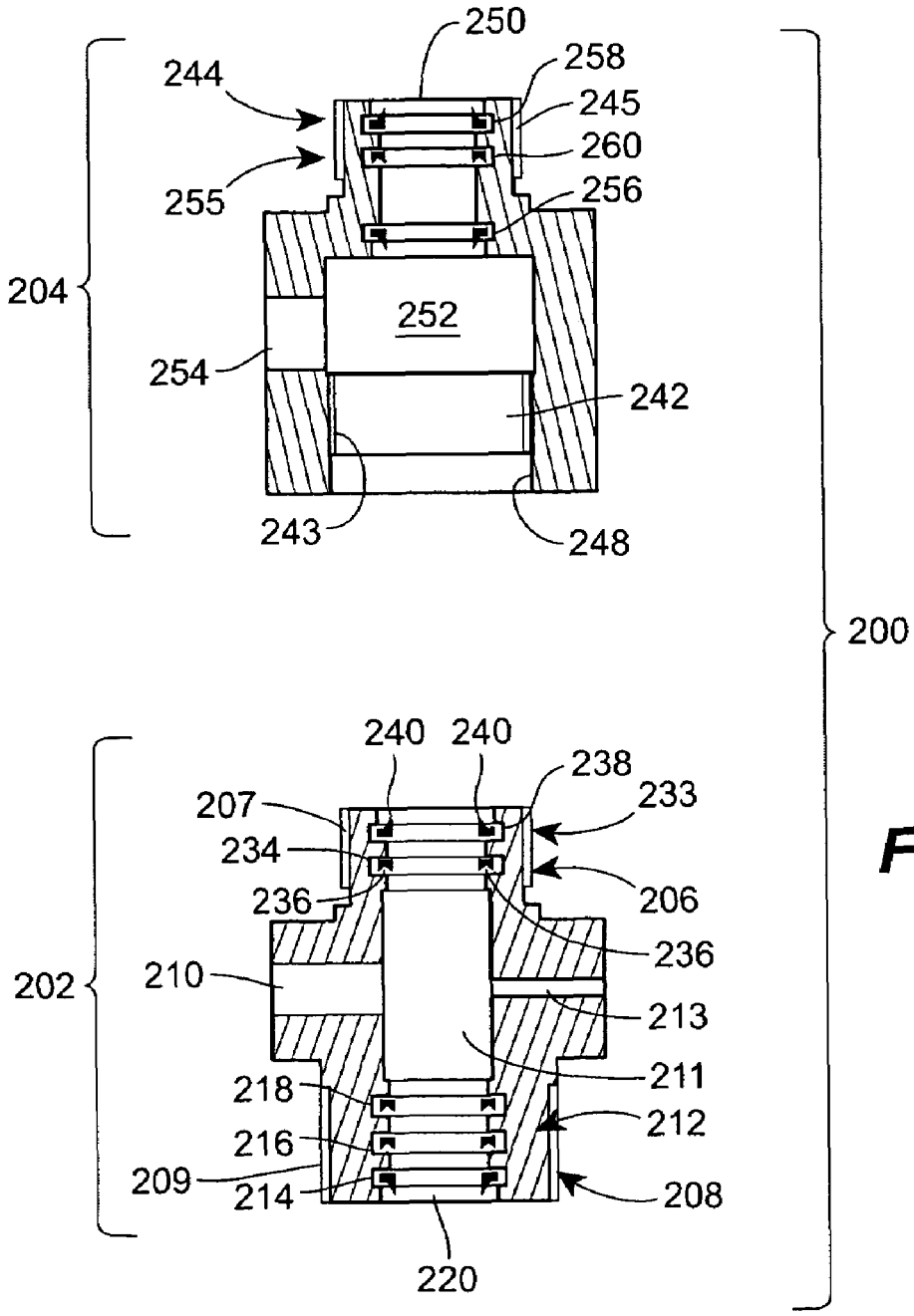
FIG. 2 illustrates a cross-section of an example unassembled capped stuffing box assembly including a stuffing box and a drain cap.

A sealing assembly 200, in the form of a capped stuffing box is shown in partially-unassembled form in FIG. 2. The assembly 200 connects the discharge tee 117 to the drive motor assembly 102. The assembly 200 may be a two-part assembly including, a first sealing assembly 202, which is a stuffing box in the illustrated example, and a second sealing assembly 204, which is a drain cap in the illustrated example. In the illustrated example, the drain cap 204 may be permanently attached to the frame 106. In the illustrated example, the stuffing box 202 operates as a primary sealing mechanism for the assembly, preventing fluid being pumped from the reservoir from entering into the drive motor assembly 102. The stuffing box 202, for example, may provide a water tight seal at the surface interface between the drive motor assembly 102 and the riser pipe 112 in which the actuating rod 118 reciprocates back and forth.

The stuffing box 202 has an upper, male thread end 206 for threadably engaging, e.g., rotatably or slidably, and aligning with the drain cap 204. The stuffing box 202 also has a lower, male thread end 208 that may threadably engage, e.g., rotatably or slidably, into the discharge tee 117 to perform the main liquid sealing for the apparatus 100, for example, by working against high liquid head pressures. By adjusting the stuffing box seal material, the stuffing box 202 may be made to handle a variety of chemical and heat conditions. The male thread end 206 is surrounded by a thread ring 207, in the illustrated example and the male thread 208 is surrounded by a thread ring 209. By way of example not limitation, the ring 207 may be a 1¼"-12 straight thread, and the ring 209 may be a tapered ⅛" NPT thread.

The stuffing box 202 includes a drain port 210 that may drain fluids from a drain cavity 211 in the stuffing box 202, for example, during bearing leakage. In this way, the drain port 210 may prevent leaking fluid from escaping into the drive motor assembly 102 or onto the surface of the geological site. Separately, the port 210 may be used to apply a lubricant to the stuffing box 202 to extend the life of seals therein and reduce friction at the point of seal or wiper contact with the actuating rod. In the illustrated example, the stuffing box 202 also has a bleed hole 213 that may be used to detect if a sufficient amount of lubrication has been applied to the stuffing box 202. By way of example, not limitation, the drain port 210 may be fitted or formed with a ⅛" NPT thread fitting for coupling the drain port 210 to a pipe reservoir, chamber, recycling system or the like (none shown). The drain port 210 and bleed hole 213 are optional, however, and may be capped or removed altogether.

Figure 3:
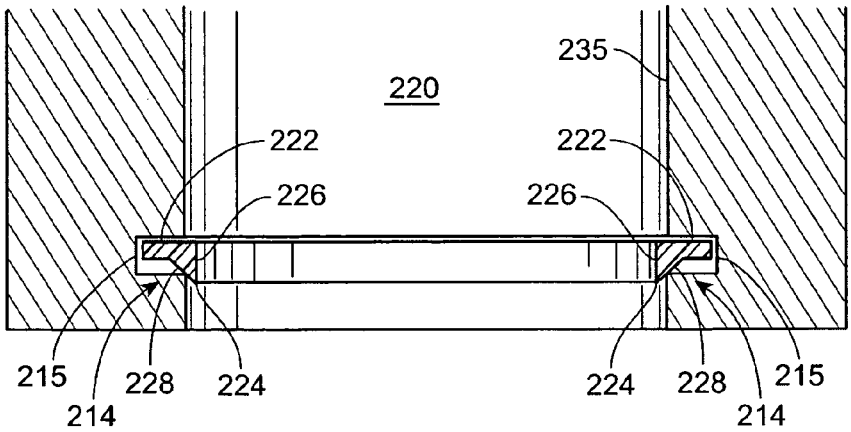
FIG. 3 illustrates a detail cross-section view of an example rod wiper that may be used in the capped stuffing box assembly of FIG. 2.

To assist in liquid sealing, the stuffing box 202 includes a variety of rod wipers and seals. A lower sealing region 212 of the stuffing box 202 includes a rod wiper 214 and two lower u-cup seals 216, 218. As illustrated in FIG. 3, the rod wiper 214 may fit into a fitting channel 215 spanning the entire circumference of a rod chamber 220 or a portion thereof. The rod wiper 214 prevents or hinders grit and other contaminants from getting into the stuffing box 202 and affecting the performance of the seals 216, 218. The rod wiper 214 also assists in liquid sealing. By way of example, not limitation, the rod wiper 214 may be formed of materials such as VITON available from E.I. du Pont, buna nitrol, polypropylenes, elastomers (synthetic or nitrile), polyurethane, ethylene propylene rubber (EPM) neoprene, KALREZ available from E.I. du Pont or other, industrial materials. The rod wiper 214 may be formed of thicker, pastier materials, as well, for example if formed as a variseal rod scraper, as discussed further below.

As illustrated in FIG. 3, the rod wiper 214 includes a base end 222 mounted in channel 215 and a wiper end 224 extending into the chamber 220 and having an inner wall 226 and an outer wall 228 slanted outward from the inner wall 226. In the illustrated configuration, the wiper end 224 may displace grit or another contaminant material outwardly from the rod chamber 220.

Figure 4:
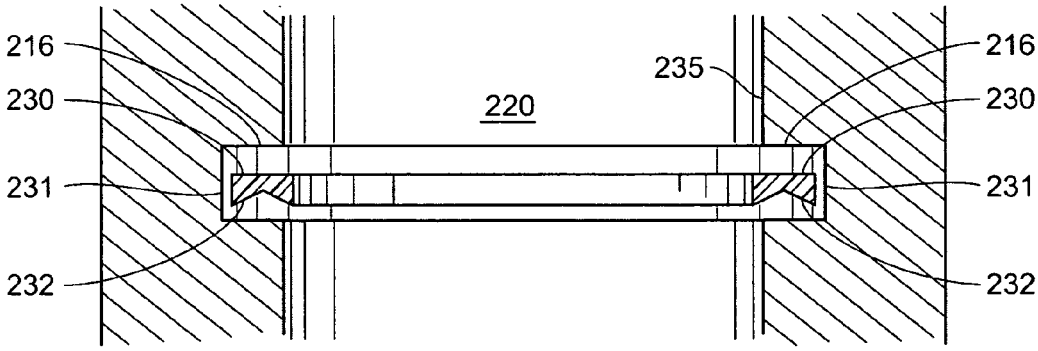
FIG. 4 illustrates a detail cross-section view of a seal, in the illustrated example a u-cup seal, that may be used in the capped stuffing box assembly of FIG. 2.

The u-cup seal 216 is illustrated by way of example in FIG. 4 and includes a base 230 mounted in a fitting channel 231 and a retainer end 232 in the form of a u-cup extending therefrom. Seal 218 may have a similar or identical configuration. The seal 216 may be considered a primary seal, while seal 218 may be considered a secondary seal. By way of example, not limitation, both seals 216, 218 are formed to have their respective retainer ends facing into the direction from which fluid will be flowing, e.g., the fluid reservoir. Alternatively, one or both of the seals 216, 218 may face along the direction of fluid flow, for example, the seals 216, 218 could have retaining ends facing toward another. The seals 216, 218 may be formed of the materials listed above for the rod wiper 214, for example.

The stuffing box 202 includes an upper sealing region 233 that includes an upper u-cup seal 234, similar to seals 216, 218 and also having a retaining end 236 facing into the direction of fluid flow. The upper seal 234 protects against fluid leaking above the stuffing box 202. To prevent dirt from the drain cap 204 from entering the stuffing box 202 and harming this upper seal 234, the stuffing box 202 includes an upper rod wiper 238 above the upper seal 234 and positioned with a wiper end 240 extending upwardly in the direction of the drain cap 204.

As illustrated, the rod wipers 214, 238 and u-cup seals 216, 218 and 234 preferably extend inwardly into the rod chamber 220 or are at least flush with an inner wall 235 or lining within the chamber 220. In some examples, and not by way of limitation, the spacing between the outer diameter of the rod 118 and the inner wall of the chamber 220 within which the rod 118 actuates is less than 1/10 of an inch, for example, between 0.0005" to 0.0025". In such examples, when engagement with the actuating rod 118 is desired, the rod wipers 214, 238 and u-cup seals 216, 218 and 234 may be positioned to extend from the inner wall 235 and into the chamber 220 by a distance equal to or substantially equal to that of this spacing distance. Alternatively, the sealing elements may be positioned so that they do not engage a piston rod or any lubricant thereon directly.

Capping the stuffing box 202 is the drain cap 204, which in the illustrated example has a machined female thread 242 and thread ring 243 for threadably engaging, whether rotationally or slidably, and aligning with the male thread 206 of the stuffing box 202. The thread ring 243 may be a straight or tapered thread ring mounted on an inner wall 248 of the drain cap 204, for example. The drain cap 204 has a machined male thread 244 and thread ring 245 for threadably engaging, whether rotationally or slidably, to the frame 106. By way of example, not limitation, the thread rings 243 and 245, as with rings 207 and 209 of the stuffing box 202, may be formed of known mating materials such as ultra high molecular weight engineered thermoplastics (e.g., DELRIN, available from E.I. du Pont, PEEK [polyetheretherketone] available from Victrex USA of Greenville, S.C., etc.) or metals (brass, iron, Stainless steel, etc).

The drain cap 204 includes a rod chamber 250 through which the actuating rod 118 travels. A drain cavity 252 communicates fluid to a drain port 254 through which any fluid, grit, or other leakage from the stuffing box 202 can be directed, for example, to a reservoir, chamber, recycling system or the like: The drain port 254 may be used as a worn seal or leakage indicator and as a controlled directional drain port to contain and direct the leaking liquid away from the well head. By way of example, not limitation, the drain port may be a ¼" NPT fitting.

To prevent fluid, grit, and other materials from leaking from the drain cavity 252, the drain cap 204 has a sealing region 255 that includes, in the illustrated example, two rod wipers 256 and 258 with wiper ends facing in opposite directions and disposed on opposite sides of a seal 260. Rod wiper 256 has a wiper end that extends into the direction of fluid flow, while rod wiper 258 has a wiper end that extends along (with) the direction of fluid flow and toward the pumping piston motor. In this way, the first rod wiper 256 may block fluid, grit, etc. from entering the piston motor from the pumping reservoir, and the second rod wiper 258 may prevent fluid, grit, etc. from entering into the drain cap 204 from the piston motor. While an opposing rod wiper configuration is illustrated, the wipers 256 and 258 are not limited to the illustrated configuration.

In the illustrated example, the seal 260 is a u-cup seal having a receiving end facing the direction of fluid flow to assist in preventing fluid leakage above the drain cap 204. As desired, multiple seals may be disposed between the wipers 256, 258, on different sides of the wipers 256, 258. Alternatively still, the seal 260 may be replaced with other sealing structures, such as a packing material or additional wipers. The structures may be removed entirely.

The threadable engagement of the drain cap 204 and the stuffing box 202 allows for change out of old or worn seals in the stuffing box with greater ease than with conventional techniques. Furthermore, the drain port 254 may be used as a worn seal indicator and as a controlled directional drain port to contain and direct the leaking liquid away from the well head. The drain cap 204 allows the liquid that is leaking to be directed to an appropriate drain collection point until the replacement stuffing box u-cup seals can be replaced.

The use of u-cup seals in a stuffing box eliminates the need to constantly readjust the tightness of a packing gland seal, the problem plaguing prior systems. The use of a single stuffing box separate from the frame of the pneumatic drive motor ensures easy field service and easy u-cup seal replacement, eliminating the need to tamper with the drive motor frame and eliminating the alignment problems of prior designs. A separate stuffing box also allows for the old stuffing box to be swapped out with a new stuffing box with new u-cup seals while the old stuffing box can be taken back for u-cup seal replacement with no down time in pump operation as the old used u-cup seals are replaced.

Furthermore, by providing a drain cavity and drain port, the drain cap may ensure that no liquid leaks out of the piston pump, which allows the pumping system to be used in pumping hazardous liquids without fear that employees will come in contact with the liquid being pumped or the surrounding surface ground. The drain cap above the stuffing box may have a large drain port that allows for any leaking fluids from the stuffing box to leak out of the capped stuffing box assembly, yet can control the leakage to a drain port. Furthermore, the drain cavity and drain port, act as the primary drainage mechanism in behind the stuffing box, in those examples that have both, to allow the piston pump to continue to work even when the stuffing box seals are worn and leaking, because the leakage is controlled and directed through the stuffing box up into the drain cap port for release. This lets the user work on u-cup stuffing box seal replacement at their convenience not necessarily at the time of stuffing box seal failure.

The stuffing box 202 and drain cap 204 may be formed of low friction bearing material, such as thermoplastic resin. By way of example not limitation, one example material is the family of acetal resins sold under the name DELRIN. In addition to being a good bearing material, DELRIN is easy to machine and is resistant to interaction with a wide range of chemicals. DELRIN, for example, does not chemically react with leachate and other chemicals pumped in typical landfill environments. DELRIN also has low moisture absorption and is UV resistant in certain forms.

The stuffing box 202 and drain cap 204 may be formed of other materials as well, including brass, which is easy to machine and is a good bearing material that can withstand high temperature conditions, such as those in steam and thermo-hydrocarbon pumping environments. Brass also will not gall against the drive rod, because brass is a dissimilar metal to the chrome-plated stainless steel drive rod typically used. Another substrate material for the stuffing box 206 and drain cap 204 material is the thermoplastic PEEK, which is an engineered plastic similar to DELRIN, but with a wider range of chemical resistances while maintaining good low friction bearing characteristics. PEEK can also withstand very high heat conditions.

These materials are provided by way of example, not limitation. The stuffing box 202 and drain cap 204 may be formed of other thermoplastic or metallic materials that exhibit good low friction bearing characteristics. Furthermore, although the stuffing box 202 and drain cap 204 may be formed of the same material, alternatively the two may be formed of different materials.

Figure 5:
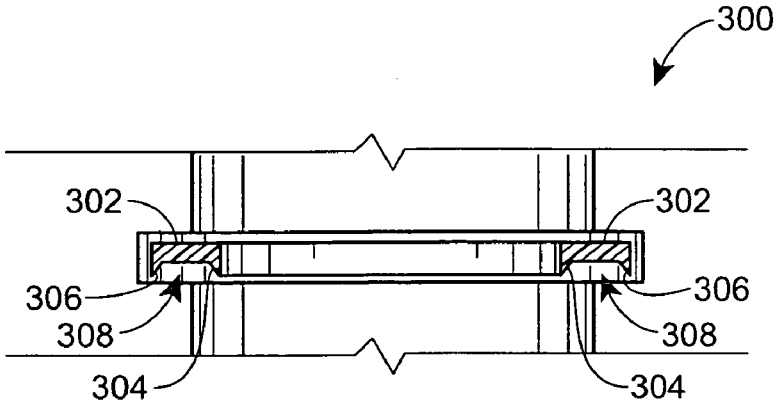
FIG. 5 illustrates another example of a rod wiper that may be used in the capped stuffing box assembly of FIG. 2.
Figure 6:
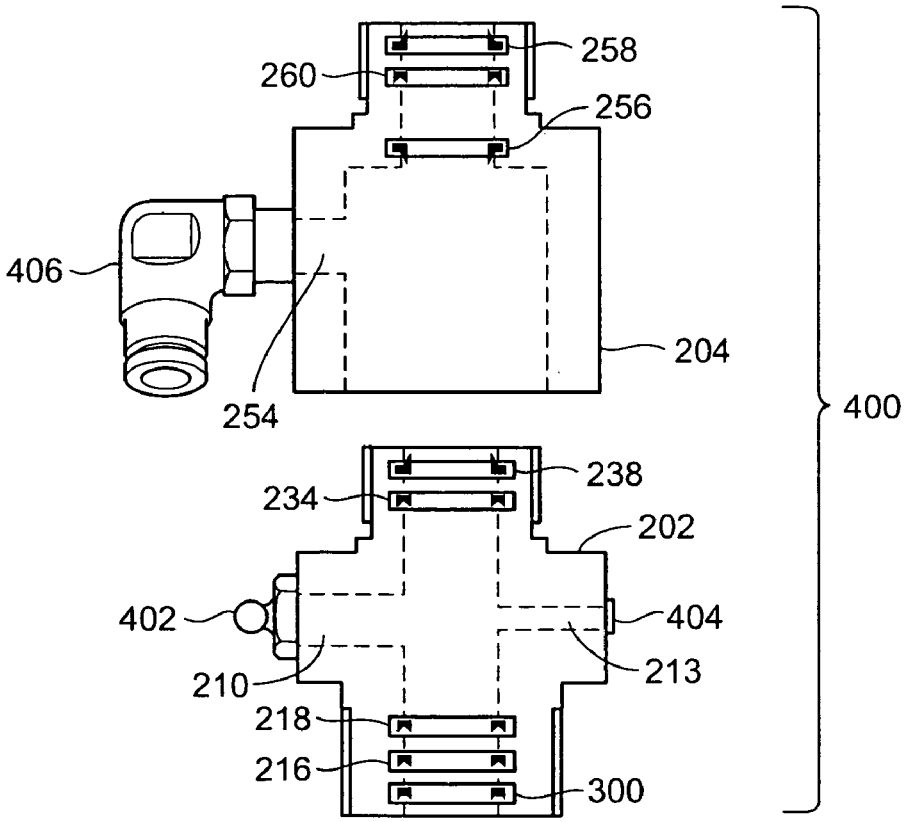
FIG. 6 illustrates another example of a capped stuffing box assembly (unassembled) using the rod wiper of FIG. 5

As an example alternative to that described above, the rod wipers illustrated in FIG. 3 may be replaced with seals, such as those illustrated in FIG. 4, or with other protective members such as a rod scraper 300, as illustrated in FIG. 5. The rod scraper 300 includes a base 302 and a scraper end 304 extending distally therefrom for engaging an actuating rod during operation. Disposed on an outer portion of the base 302, opposite the scraper end 304, is a retainer end 306 that forms a retainer recess 308 with the scraper end 304. A capped stuffing box 400 including the rod scraper 300 (and retaining like reference numerals for the elements similar to those of FIG. 1) is shown in FIG. 6. The capped stuffing box 400 has the drain port 210 capped with a removable fitting 402, and the bleed hole 213 capped by a controllable release screw 404 for controllably releasing or stopping the release of fluid from the bleed hole 213. The assembly 400 also includes an elbow fitting 406, with spigot, threadably engaged with the drain port 254 of the drain cap 204.

Various capped stuffing box devices are described. The devices may be used in pumping systems such as those deployed in landfill applications, including leachate recovery in horizontal and vertical leachate recovery wells, methane gas well dewatering, and methane gas sump and gas condensate recovery. The techniques may be used to pump fluid from a landfill where landfill leachate may be corrosive and ranging from between 70° F.-180° F., or may reach temperatures of 200° F. or more, for example. The system 100 may be used to pump from depths of 100 feet or more below the ground surface. The devices are not limited to particular applications, however, and may be used in groundwater remediation recovery contaminated liquids, oils, tars, greases, oil refinery remediation and recovery of spilled petroleum product; and chemical refinery remediation of spilled chemicals, hazardous liquids; and pipe line spills. Applications may include high temperature, steam injection, and electro thermal environments.

Furthermore, although the capped stuffing boxes are described for use in pumping fluids from underground reservoirs, the capped stuffing boxes may be used in above ground pumping applications where it is desirable to protect a piston drive mechanism from contamination by fluids being pumped in the pipe through which the drive rod reciprocates.

In addition to removal of liquid form fluids, the techniques may be used to remove gaseous fluids. A typical landfill, for example, produces gaseous wastes (e.g., methane). These gases may be removed from the landfill through the same recovery wells used to remove leachate.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalence.

What we claim is:

1. A stuffing box assembly for use in a pumping system for communicating fluid with a well casing, the pumping system having a drive motor mounted to a frame for driving a piston rod, the stuffing box assembly comprising:

a stuffing box mounted to the well casing, the stuffing box having a first liquid seal region to seal against the piston rod to protect against fluid leakage; and a stuffing box cap removably mounted to the stuffing box and separately mounted to the frame, the stuffing box cap having a second liquid seal region to seal against the piston rod to protect against fluid leakage, and the stuffing box cap having a drain port for draining leaked fluid.

2. The assembly of claim 1, wherein the first liquid seal region and the second liquid seal region each comprise at least one u-cup seal, each u-cup seal having a receptacle end facing into a direction of fluid flow for the pumping system.

3. The assembly of claim 1, wherein the first liquid seal region includes a primary liquid seal and a secondary liquid seal having a receptacle end facing into the direction of fluid flow for the pumping system.

4. The assembly of claim 3, wherein the first liquid seal region comprises a rod wiper disposed between the well casing and at least one of the primary liquid seal and the secondary liquid seal.

5. The assembly of claim 4, wherein the rod wiper has a base portion and a wiper end portion extending distally from the base portion and into the direction of the fluid flow.

6. The assembly of claim 1, wherein the stuffing box includes a port for communicating fluid.

7. The assembly of claim 6, wherein the stuffing box includes a third liquid seal region, wherein the first liquid seal region is disposed on a primary side of the port and the third liquid seal region is disposed on a secondary side of the port.

8. The assembly of claim 7, wherein the stuffing box further includes a first rod wiper disposed in the first liquid seal region and a second rod wiper disposed in the third liquid seal region.

9. The assembly of claim 1, wherein the stuffing box includes a first male thread for engaging the stuffing box cap and a second male thread for engaging a discharge tee of the pumping system.

10. The assembly of claim 1, wherein the stuffing box cap comprises a first rod wiper having a first wiper end and a second rod wiper having a second wiper end, wherein the first wiper end extends along the direction of fluid flow and wherein the second wiper end extends into the direction of fluid flow.

11. The assembly of claim 10, wherein the first rod wiper and the second rod wiper are disposed on opposite sides of a further liquid seal.

12. The assembly of claim 10, wherein the stuffing box cap is permanently mounted to the frame and releasably engaged with the stuffing box.

13. The assembly of claim 1, wherein the stuffing box is formed from a thermoplastic resin.

14. The assembly of claim 1, wherein the stuffing box is formed from a material selected from the group consisting of acetal resins, polyetheretherketone, and brass.

15. The assembly of claim 1, wherein the stuffing box and the stuffing box cap are formed of different materials.

16. A pumping assembly for pumping fluid from an underground reservoir through a well casing, the pumping assembly comprising: a frame; a piston rod drive assembly mounted to the frame for actuating a piston rod in the well casing to pump fluid through the well casing; a first sealing assembly releasably mounted to the well casing, the first sealing assembly sealing against the piston rod during actuating movement: and a second sealing assembly fixedly mounted to the frame and releasably mounted to the first sealing assembly, the second sealing assembly sealing against the piston rod during actuating movement and having a drain port for communicating fluid leakage from the first sealing assembly.

17. The pumping assembly of claim 16, further comprising a fluid discharge assembly mounted to the well casing for communicating fluid from the reservoir, where the first sealing assembly is releasably mounted to the fluid discharge assembly.

18. The pumping assembly of claim 16, wherein the first sealing assembly includes a first liquid seal region comprising at least one u-cup seal having a receptacle end facing into a direction of fluid flow, and wherein the second sealing assembly includes a second liquid seal region comprising at least one u-cup seal having a receptacle end facing into a direction of fluid flow.

19. The pumping assembly of claim 16, wherein the first sealing assembly includes a rod wiper having a base portion and a wiper end portion extending distally from the base portion and into the direction of the fluid flow, where the wiper end seals against the piston rod during actuating movement.

20. The pumping assembly of claim 16, wherein the second sealing assembly includes a rod wiper having a base portion and a wiper end portion extending distally from the base portion and into the direction of the fluid flow, where the wiper end seals against the piston rod during actuating movement.

* * * * *